United States Patent [19]

Smith

[11] Patent Number: 4,663,789

[45] Date of Patent: May 12, 1987

[54] HYDRAULIC BAFFLE FOR WATERBED MATTRESS

[75] Inventor: John W. Smith, Rexdale, Canada

[73] Assignee: Halcyon Waterbed Inc., Downsview, Canada

[21] Appl. No.: 833,264

[22] Filed: Feb. 27, 1986

[51] Int. Cl.[4] ..... A47C 27/08
[52] U.S. Cl. ..... 5/450; 5/451
[58] Field of Search ..... 5/451, 450, 455, 449, 5/422, 457

[56] References Cited

U.S. PATENT DOCUMENTS

| | | | |
|---|---|---|---|
| 4,192,031 | 3/1980 | Fogel | 5/451 |
| 4,204,289 | 5/1980 | Fogel | 5/451 |
| 4,241,465 | 12/1980 | Yarimie et al. | 5/452 |
| 4,247,962 | 2/1981 | Hall | 5/451 |
| 4,296,510 | 10/1981 | Phillips | 5/451 |
| 4,325,152 | 4/1982 | Carpenter | 5/451 |
| 4,345,348 | 8/1982 | Hall | 5/451 |
| 4,399,575 | 8/1983 | Hall | 5/451 |
| 4,430,764 | 2/1984 | Finkelstein | 5/451 |
| 4,467,485 | 8/1984 | Hall | 5/451 |
| 4,475,257 | 10/1984 | Phillips | 5/451 |
| 4,523,343 | 6/1985 | Fraige | 5/451 |
| 4,577,356 | 3/1980 | Johenning | 5/450 |

FOREIGN PATENT DOCUMENTS

| | | | |
|---|---|---|---|
| 1175168 | 9/1984 | Canada | 5/451 |
| 1175167 | 9/1984 | Canada | 5/451 |

OTHER PUBLICATIONS

"Del-Astra", an ad in the Sep. 1982 issue of Flotation Sleep Industry Magazine.

*Primary Examiner*—Alexander Grosz
*Attorney, Agent, or Firm*—Riches, McKenzie & Herbert

[57] ABSTRACT

A damping structure is disclosed to float freely within the envelope of a waterbed mattress. The damping structure comprises a bottom panel of flexible sheet material with a number of tubular structure extending upwardly therefrom. Each tubular structure is coupled to the bottom panel with a portion of the bottom panel closing the bottom end of the tubular structure. The tubular structure has side walls and is closed at a top end by a top panel. The top panels are buoyant and float the tubular structures upwardly so as to suspend the bottom panel spaced above the bottom sheet of the waterbed envelope. Ports are provided through the top panels, side walls and bottom end of the tubular structures and serve to permit fluid flow into and out of the tubular structures to assist in facilitating fluid displacement within the mattress and dampen wave motion therein. The ports through the side walls are open to permit flow even when the mattress is compressed in use. The ports through the top panel are normally closed by engagement with the top sheet of the envelope and the ports through the bottom panel become closed upon compression of the mattress by engagement of the bottom panel with the bottom sheet of the envelope. The novel configuration of the bottom panel, tubular structures, and ports therethrough provides improved wave dampening.

11 Claims, 5 Drawing Figures

HYDRAULIC BAFFLE FOR WATERBED MATTRESS

SCOPE OF THE INVENTION

The present invention relates to waterbed mattresses and, more particularly, to a waterbed mattress with a free floating internal baffle structure to dampen wave motion within a waterbed mattress.

BACKGROUND OF THE INVENTION

Waterbeds are well known as devices comprising a fluid filled envelope upon which a person may recline with the person comfortably supported thereon as a result of fluid displacement.

Many attempts have been made to reduce the effects of wave motion generated in waterbed mattresses. For example wave reducing devices have been proposed by U.S. Pat. No. 4,204,289 to Fogel, U.S. Pat. No. 4,325,152 to Carpenter and U.S. Pat. No. 4,475,257 to Phillips. These devices have suffered a number of disadvantages.

In Fogel and Carpenter, baffles are coupled to the bottom sheet of the envelope forming the waterbed mattress, making the envelope difficult to manufacture. With the baffles coupled to the bottom sheet, forces arising in dampening wave motion are transmitted to the seams joining the baffles to the bottom sheet, increasing the incidence of tearing of the bottom sheet and leakage of the envelope.

U.S. Pat. No. 4,475,257 to Phillips teaches a "hydraulic" mattress. Compartments within the mattress become completely closed with the closed compartments, due to hydraulic pressure therein, preventing further compression of the mattress. However, the compartments are formed from vinyl sheeting which cannot withstand the considerable hydraulic forces generated when a person's weight is concentrated on a few such compartments. After repeated use, the walls of the compartment typically rupture. Moreover, when the compartments of Phillips become completely closed, the compartments feel relatively hard to a user.

Accordingly, it is an object of the present invention to at least partially overcome the disadvantages of known wave reducing devices by providing a free floating damping structure comprising a bottom panel of flexible sheet material with a plurality of tubular structures extending upwardly therefrom wherein fluid flow restricting ports are provided through the top, bottom and side walls of the tubular members.

Another object is to provide an improved damping structure with effectively dampens wave motion within a waterbed mattress.

In one of its aspects, the present invention provides, in a waterbed mattress comprising a top sheet and a bottom sheet joined together to form a sealed envelope filled with liquid, an improvement comprising a damping structure floating freely within the envelope to dampen wave action in the mattress, the damping structure comprising a bottom panel of flexible sheet material extending over substantially the entirety of the upper surface of the bottom sheet, a plurality of vertically disposed tubular structures coupled to the bottom panel to each extend independently upwardly therefrom, the tubular structures distributed over the bottom panel, each tubular structure having side walls of flexible material and a top panel with the side walls coupled to the bottom panel to close a bottom end of the tubular structure and with the side walls coupled to the top panel to close a top end of the tubular structure, the top panel, bottom end and side walls of each tubular structure having, respectively, top port means, bottom port means, and side port means therethrough to permit liquid flow into and out of the tubular structure, each top panel comprising a thin plate of low density floatation means to float the top end of the tubular structure upwardly into engagement with the undersurface of the top sheet and restrict liquid flow through the top port means, the tubular structures being of a length that:

(a) when the mattress is uncompressed, the bottom panel hangs downwardly from the top panels with the bottom panel spaced from the uppersurface of the bottom sheet, and (b) when the mattress is compressed, the bottom panel engages the upper surface of the bottom sheet restricting liquid flow through the bottom port means.

The present invention provides a damping structure to float freely within the envelope of a waterbed mattress to dampen wave action therein. The damping structure comprises a bottom panel of flexible sheet material with a number of vertically disposed tubular structures or elements extending upwardly therefrom. Each tubular structure is coupled to the bottom panel with a portion of the bottom panel closing the bottom end of the tubular structure. The tubular structure has a side wall and is closed at a top end by a top panel. The top panels are buoyant and serve to float the tubular structure upward suspending the bottom panel from the tubular structures spaced from the bottom sheet of the waterbed envelope. Ports are provided through the top end, side walls and bottom end of the tubular structures to permit fluid flow into and out of the tubular structures. While the ports through the side walls are, even when the mattress is compressed in use, open to permit flow into and out of the tubular structures, the ports in the top end are normally substantially closed by engagement of the top ports with the upper sheet of the envelope and the ports in the bottom end become effectively closed when the mattress is compressed in use so as to bring portions of the bottom panel comprising bottom ends of tubular elements into engagement with the bottom sheet of the envelope.

The bottom panel effectively divides the mattress into a lower compartment therebelow and on upper compartment containing the tubular structures thereabove. Preferably, the bottom panel extends substantially co-extensively over the area of the envelope. Preferably, the tubular structures cumulatively retain a major portion of the total liquid in the envelope, preferably at least 70%. Preferably the upper compartment should be of substantially greater volume than the lower compartment, with for example the upper compartment comprising at least 80% of total volume of the envelope.

BRIEF DESCRIPTION OF THE DRAWINGS

Further objects and advantages of the preferred invention will become apparent from the following description, taken together with the accompanying drawings in which.

DETAILED DESCRIPTION OF THE DRAWINGS

Figure 1:
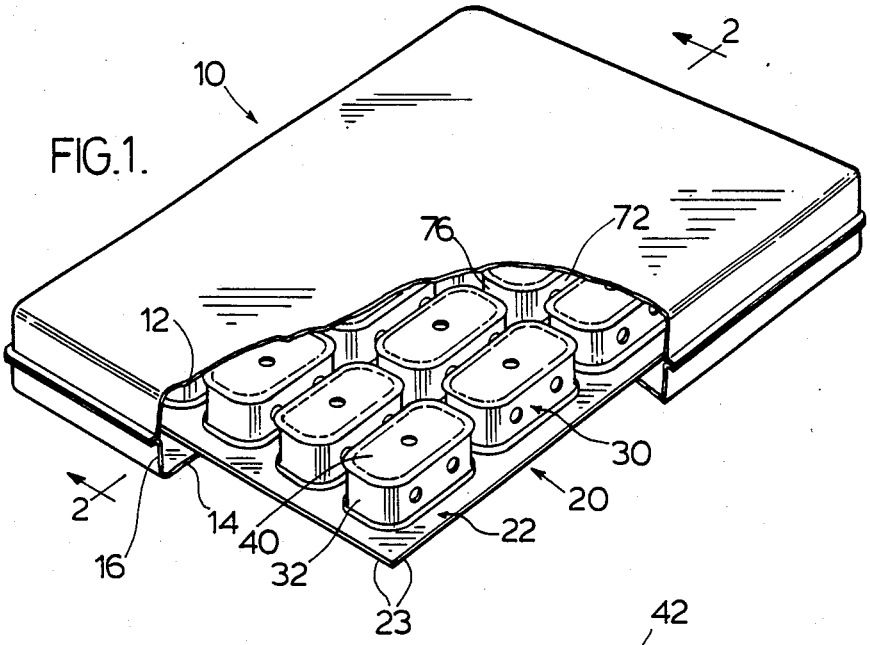
FIG. 1 is a perspective view of a waterbed mattress with portions broken away to reveal a preferred embodiment of the free floating damping structure of the present invention.
Figure 2:
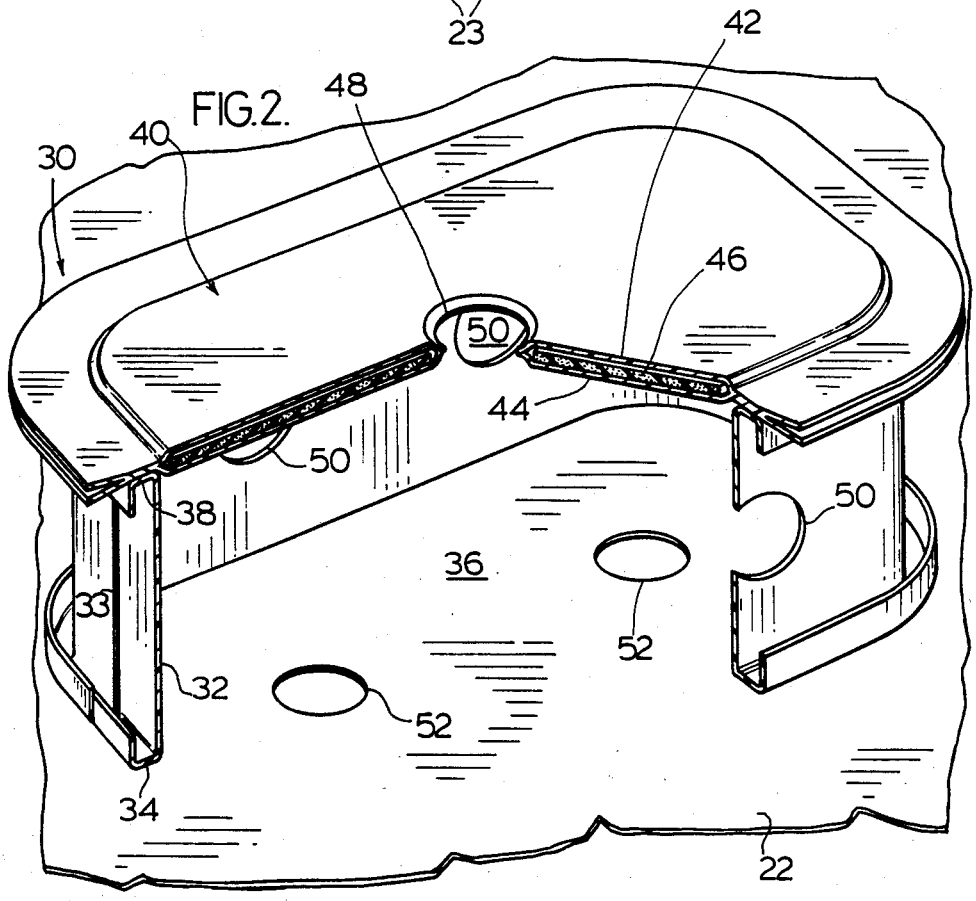
FIG. 2 is a perspective view of one tubular element of the damping structure of FIG. 1 with portions broken away to show its construction.

Reference is made first to FIG. 1 which shows a waterbed mattress 10 comprising an envelope of thin flexible plastic sheet material. The mattress has a top sheet 12, a bottom sheet 14 and peripheral side walls 16 retaining a relatively dense liquid, preferable water 18 therein. On a person reclining on mattress 10, the person will be comfortably supported thereon as a result of displacement of water 18.

The damping structure in accordance with the present invention is generally designated 20 in FIG. 1. Damping structure 20 comprises a bottom panel 22 with a plurality of tubular structures or elements 30 distributed thereover.

Bottom panel 22 preferably comprises flexible sheet material and covers an area substantially co-extensive with the area of bottom sheet 14 with peripheral side and end edges 23 of bottom panel 22 located relatively closely to the peripheral side walls 16 of mattress 10.

Each tubular element 30 comprises a side wall 32 of flexible sheet material and a top panel 40. Side wall 32 is shown as a length of sheet material with its ends sealed together along weld line 33 to form a loop of generally rectangular configuration with rounded corners. The bottom edge of side wall 32 is folded to form a bottom flange 34 welded to bottom panel 22 and thus closing the bottom end 36 of tubular element 30. A similar top flange 38 at the top edge of side wall 32 is welded to top panel 40 closing the top end of tubular element 30. Top panel 40 comprises two sheets 42 and 44 of flexible material sealed together about their edges and sandwiching therebetween a thin layer of low density flotation material shown as floatation plate 46.

Top panel 40 is provided with a top port 48 therethrough. Side wall 32 is provided with side ports 50 shown in the longer sides thereof. The bottom end 36 of tubular element 30 is provided with bottom ports 52 through bottom panel 22. The top port 48, side ports 50 and bottom ports 52 are provided to permit flow of water 18 into and out of the interior of tubular element 30 as is advantageous to dampen wave motion in mattress 10.

Tubular element 30 may be seen to be substantially closed with the exception of ports 48, 50 and 52.

Bottom panel 22 and tubular elements 30 with the exception of floatation plate 46, are preferably made entirely of flexible sheet material having a density greater than water. Floatation plate 46 is chosen so that the floatation plates of all the tubular elements may collectively provide the damping structure 20 with positive floatation. The tubular elements are floated upwardly by the floatation plates so the tubular elements are vertically disposed with bottom panel 22 coupled thereto to hang downwardly therefrom as best seen in FIG. 3.

Figure 3:
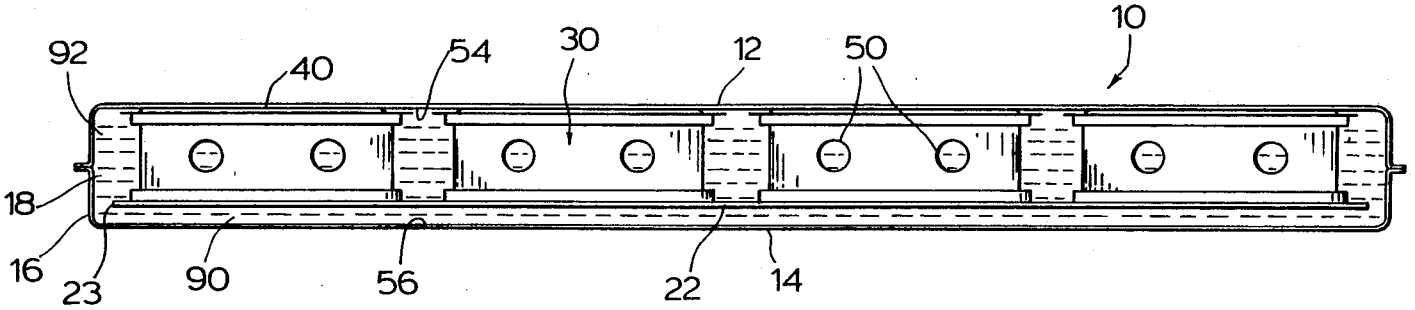
FIG. 3 is a cross-sectional side view of a segment of the mattress of FIG. 1 when uncompressed.

FIG. 3 shows mattress 10 filled with water and in an uncompressed state, that is, without a person or other object supported by the mattress. Damping structure 20 floats freely within mattress 10 and is not secured to the mattress. Tubular elements 30 are chosen to have a height less than the depth of the mattress, said depth being measured as the vertical distance between top sheet 12 and bottom sheet 14 when the mattress is uncompressed. As seen in FIG. 3, when the mattress is uncompressed, the top panels float the damping structure 20 upward with top panels 40 engaging the undersurface 54 of top sheet 12 and with bottom panel 22 hanging downwardly from the tubular elements spaced from the uppersurface 56 of bottom sheet 14.

As seen in FIG. 3, bottom panel 22 divides the envelope into a lower compartment 90 therebelow and an upper compartment 92 thereabove including tubular elements 30. Preferably, peripheral edges 23 are relatively closely adjacent to peripheral side walls 16 of the mattress.

Figure 4:
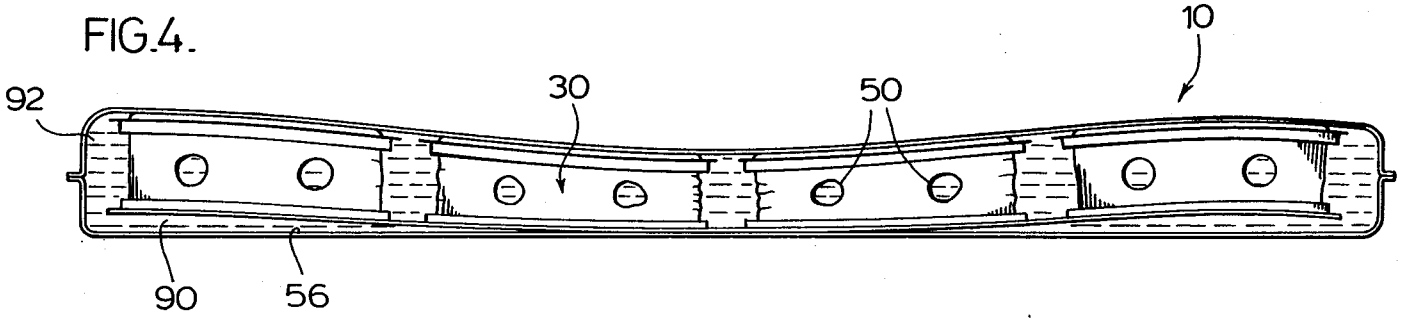
FIG. 4 is a cross-sectional side view similar to that shown in FIG. 3 but with the mattress compressed.

FIG. 4 shows mattress 10 filled with water but in a compressed state as, for example, with a person lying on top sheet 12 to at least partially reduce the depth of mattress centrally thereof. As seen, the depth of the mattress is reduced to an extend that bottom panel 22 engages uppersurface 56 of bottom sheet 14, with tubular element 30 being correspondingly compressed.

The engagement of top panels 40 with the undersurface of the top sheet 12 due to upward floatation serves to effectively close top port 48 thereby restricting flow of water through top port 48 into and out of the tubular elements. Similarly, when the mattress is compressed as shown in FIG. 4, the engagement of bottom panel 22 with the uppersurface of bottom sheet 14 serves to effectively close bottom port 52 thereby restricting flow of water through bottom port 52 into and out of the tubular elements.

When top panels 40 engage top sheet 12 and bottom panel 22 engages bottom sheet 14, water flow out of a tubular element due to compression of the mattress is substantially through side ports 50. Restriction of water flow into and out of the tubular elements may assist in controlling the rate at which the mattress may be depressed.

Side ports 50 are preferably located so that even with substantial compression of the mattress in use, side ports 50 will remain open and permit liquid to flow into and out of a tubular element 30. By suitable location and sizing of side ports 50, while rates of flow therethrough may be restricted, sufficient flow may be permitting to prevent excessive build up of pressure inside a tubular element 30 as may cause rupture of the walls of the tubular element.

Preferably as shown, side ports 50 in one tubular element 30 are disposed opposed to and directly opposite side ports 50 in an adjacent tubular elements. When water may flow out of such two adjacent tubular elements, flow out of opposed side ports may interact creating destructive interference. Location of adjacent tubular elements relatively close together assists in creating such destructive interference.

As may be seen tubular elements are shown as substantially rectangular in plan view with the tubular elements located in an array on bottom panel 22 to define a matrix or network of narrow interconnecting channels 72 and 76 therebetween. As seen, side walls 32 along each (longer) side of tubular elements 30 are spaced from an adjacent tubular member 30 by a relatively narrow longitudinal channel 72 while side walls along each (shorter) end of tubular members 30 are spaced from an adjacent tubular member 30 by a relatively narrow transverse channel 76.

Advantageously a major portion of the liquid in the envelope is retained within the tubular elements 30, cumulatively, so that substantial compression of the mattress requires fluid displacement from the tubular elements. Providing tubular elements to be substantially rectangular as shown assists in increasing the relative volume of the tubular elements 30 compared to the volume of channels 72 and 76. The corners of tubular elements 30 are preferably as of small a radius as practical to accomodate continuous flanges 34 and 38. That the transverse channels 72 and longitudinal channels 76 may have a relatively small volume is advantageous to increase the velocity of fluid flow therethrough, with possible destructive interference of flow at the intersection of transverse channels with longitudinal channels.

It is to be appreciated that fluid displacement and wave propagation within the mattress as a result of compression of the mattress during use will be complex.

In an unbaffled mattress, when an impact (such as from a person sitting or moving on the mattress) is made on the mattress surface, unimpeded waves arise because nothing restricts the simple harmonic motion of water. Such waves typically have simple sinusoidal wave form with the side walls of a waterbed frame making the bed behave much like a wave tank. In the mattress in accordance with the present invention, the water volume is divided up into a number of chambers, defined by the interior of tubular elements 30. When an impact is made on the mattress surface, wave motion starts inside a chamber, and propagates for an initial moment in the same way as in an unbaffled mattress. But when the wave hits the wall of the first tubular element, some of the wave is reflected and some is transmitted. The transmitted portion has a phase shift in that it had to transverse a different medium namely, the side walls of tubular member 30, typically of vinyl. Since the wall is thin, the phase shift may be small. As the wave continues to progagate, it encounters a new wall every few inches. The cumulative effect of these reflections and phase changes at every wall create so much destructive interference that the wave damps to a very low amplitude relatively quickly, typically under 2 seconds. The preferred selection of the tubular members 30 to be rectangular is believed to assist in creating destructive interference.

Tubular members 30 are not interconnected at their top. This permits the tubular members to effectively act independently, moving and swaying substantially independently of the other tubular members. The independent movement of the tubular members is believed to better assist in breaking up wave motions than if they are to act in unison. That the tubular elements act independently gives a yielding, comfortable upper surface to the mattress.

In a mattress of the present invention liquid will flow between the upper and lower compartments to accomodate mattress compression. Such fluid displacement will involve a complex channeling of liquid through ports of the tubular members, along channels 72 and 76 and about the edges of bottom panel 22. Flow patterns will vary depending upon whether the mattress is sufficiently compressed to have the bottom sheet engage and close any of bottom ports 52.

In an uncompressed mattress as shown in FIG. 3, fluid displacement on initial compression is believed to comprise to a substantial extent flow of fluid within lower compartment 90 away from the region of compression. Once fluid in lower compartment 90 below the region of compression has been displaced and bottom panel 22 of a given tubular element 30 engages bottom sheet 14, further displacement of fluid from that given tubular element to lower compartment 90 is to be expected to be by flow out of side ports 50 of the given tubular element into channels 72 and 76. Restricting the size of ports 50, 52 may serve to limit the speed at which the mattress may be compressed by providing resistance to displacement.

A sample mattress in accordance with the embodiment shown in FIG. 1 was made for an envelope for a queen size mattress with the envelope having an overall length of about 84 inches, a width of about 60 inches and a depth of about 8 inches. To fit closely inside the mattress the bottom panel was made to have a length of about 83 inches and a width of 59 inches. Each tubular element had a height of about 7 inches, a length of about 20 inches and a width of about 11 inches. The width of each channel 72 and 76 was about 1 inch. Similarly, peripheral tubular elements were spaced from peripheral edges of bottom panel 22 about 1 inch. Ports 48, 50 and 52 were chosen to be circles of about 2 inch diameter although ports in the range of 1 to 3 inches were found acceptable.

In this exemplary sample mattress, the volume of the upper compartment 92 represents a volume of about 87.5% of the total volume of the envelope. It is preferred that the upper compartment represent at least 80% of the total volume.

In the exemplary sample mattress, the cumulative volume of the tubular elements represents about 84% of the total volume. It is preferred that the cumulative tubular elements represent at least 70% of the total volume.

A preferable material from which the damping apparatus may be manufactured is vinyl sheeting with the exception of the floatation plate which preferable comprises closed cell foamed plastic material such as polyethylene. The vinyl sheeting preferably will be 20 mil (20/1000 inch) although 12 mil is suitable as are thicknesses greater than 20 mil provided it is not so stiff as to be readily felt through the mattress.

Figure 5:
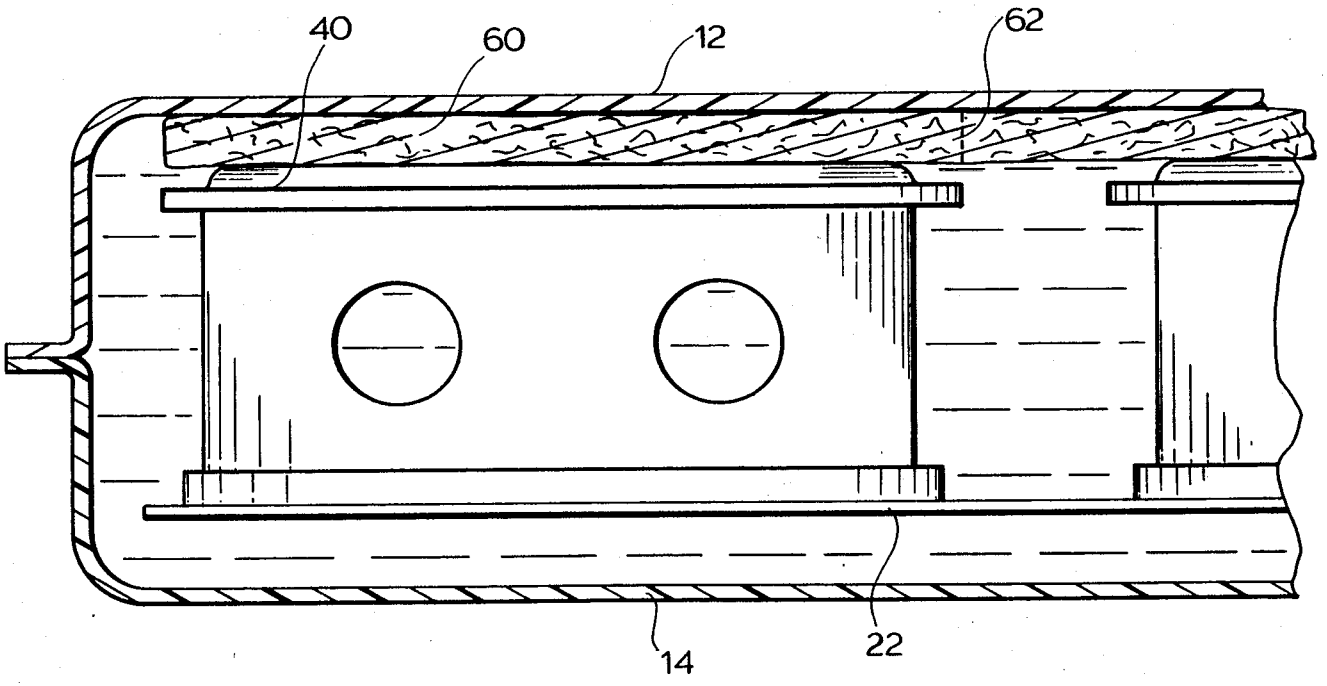
FIG. 5 shows an enlarged cross-sectional side view similar to FIG. 3 showing an optional fibre pad.

Reference is now made to FIG. 5 which shows a side view of a mattress which is the same as the mattress of FIGS. 1 to 4 with the exception of the inclusion of a fibrous matt 60 disposed between top panel 40 and the undersurface 54 of top sheet 12. Matt 60 assists in making the top surface feel softer, in cushioning wave-causing impacts on top sheet 12 and in damping wave motion due to its inertia. Matt 60 preferable comprises a resiliently deformable bonded fiber product of unwoven fibers bonded together with a binder to provide loft and resiliency. Water may flow through the matt so that the matt can serve to keep top ports 48 spaced from top sheet 12 and hence open to fluid flow therethrough substantially at all times.

Matt 60 is shown in FIG. 5 to extend as a single continuous matt above all top panels 40 so that matt 60 overlies the entirety of bottom panel 22. In this case, it is preferred that the matt 60 be coupled to top panels 40 of the peripheral tubular elements 30, leaving interior tubular members 30 free to move independently.

An individual matt 60 may be provided for each tubular element 30, secured to the top panel 40 thereof, illustrated in FIG. 5 as if matt 60 above the left-hand most tubular element 30 were to end at dotted line 62 and merely be co-extensive with top panel 40.

Matt 60 floats under top sheet 12 either due to its own buoyance or due to floatation from top panel 40. Preferred fibers for matt 60 include polyester fibers particularly those of a thickness of 40 denier and greater. Mixtures of polyester and other fibers may be used.

The matt may preferably have a thickness of about one inch, preferably between about one half inch and one and one half inches, with the height of tubular elements 30 preferably reduced accordingly.

Matts preferably may have comprise about 1 to 2 ounces of unwoven fiber per square foot area of the matt. Preferably its specific gravity may be close to 1.0.

While the invention has been described with reference to preferred embodiments the invention is not so limited. Many variations will now occur to those skilled in the art. For a definition of the invention, reference is made to the appended claims.

What I claim is:

1. In a waterbed mattress comprising a top sheet and a bottom sheet joined together to form a sealed envelope filled with liquid, the improvement comprising a damping structure floating freely within the envelope to dampen wave action in the mattress, the damping structure comprising:

a bottom panel of flexible sheet material extending over substantially the entirety of the upper surface of the bottom sheet, a plurality of vertically disposed tubular structures coupled to the bottom panel to each extend independently upwardly therefrom, said tubular structures having free floating and independent top ends which are not interconnected, the tubular structures distributed over the bottom panel, the cumulative volume of the tubular structures comprising a substantial amount of the total volume of the envelope, each tubular structure having side walls of flexible material and a substantially horizontal top panel with the side walls coupled to the bottom panel to close a bottom end of the tubular structure and with the side walls coupled to the top panel to close a top end of the tubular structure, the top panel, bottom end and side walls of each tubular structure having, respectively, top port means, bottom port means, and side port means therethrough to permit relatively free liquid flow into and out of the tubular structure, each top panel comprising a thin plate of low density floatation means to float the top end of the tubular structure upwardly into engagement with the undersurface of the top sheet and restrict liquid flow through the top port means, the tubular structures being of a height that:

(a) when the mattress is uncompressed, the bottom panel hangs downwardly from the top panels with the bottom panel spaced from the uppersurface of the bottom sheet, and (b) when the mattress is compressed, the bottom panel engages the uppersurface of the bottom sheet restricting liquid flow through the bottom port means.

2. The improved waterbed mattress of claim 1 wherein the side port means permit liquid flow therethrough even when the mattress is substantially compressed in use.

3. The improved waterbed mattress of claim 2 wherein the tubular structures are substantially rectangular and located spaced from one another in an array on the bottom panel to define narrow interconnecting channels therebetween.

4. The improved waterbed mattress of claim 3 wherein side port means of adjacent tubular structures are located to directly oppose each other and are spaced by the narrow channels.

5. The improved waterbed mattress of claim 1 wherein when the mattress is uncompressed the bottom panel divides the mattress into a lower compartment therebelow and an upper compartment containing the tubular structures thereabove with peripheral edges of the bottom panel closely adjacent peripheral walls of the envelope.

6. The improved waterbed mattress of claim 5 wherein the volume of the upper compartment compresses at least 80 percent of the total volume of the envelope and the cumulative volume of the tubular structures comprises at least 70 percent of the total volume of the envelope.

7. The improved waterbed of claim 1 wherein when the mattress is uncompressed, the bottom panel divides the mattress into a lower compartment therebelow and an upper compartment containing the tubular structures thereabove, the volume of the upper compartment comprising at least 80 percent of the total volume of the envelope and the cumulative volume of the tubular structures comprising at least 70 percent of the total volume of the envelope.

8. The improved waterbed mattress of claim 1 wherein resiliently deformable bonded fiber batt means of unwoven fibers bonded together with a binder is disposed between the top panels and the undersurface of the top sheet.

9. The improved waterbed mattress of claim 8 wherein the fiber batt means comprises a unitary member overlying all the top panels.

10. The improved waterbed mattress of claim 9 wherein the batt means is coupled to tubular elements located about the periphery of the bottom panel.

11. The improved waterbed mattress of claim 8 wherein the fiber batt means comprises a plurality of individual members each coupled to one of the top panels and being substantially coextensive therewith.

* * * * *